US010925332B2

(12) United States Patent
Quantz

(10) Patent No.: US 10,925,332 B2
(45) Date of Patent: Feb. 23, 2021

(54) ONE SIZE FITS ALL ADJUSTABLE ZIP WRAP / KNEE BRACE CONTRACTOR KNEE PADS

(71) Applicant: Frank Stephen Quantz, Northglenn, CO (US)

(72) Inventor: Frank Stephen Quantz, Northglenn, CO (US)

( * ) Notice: Subject to any disclaimer, the term of this patent is extended or adjusted under 35 U.S.C. 154(b) by 0 days.

(21) Appl. No.: 16/112,399

(22) Filed: Aug. 24, 2018

(65) Prior Publication Data

US 2019/0274379 A1 Sep. 12, 2019

Related U.S. Application Data

(63) Continuation-in-part of application No. 15/915,006, filed on Mar. 7, 2018, now abandoned.

(51) Int. Cl.
*A41D 13/06* (2006.01)
*A41D 31/02* (2019.01)

(52) U.S. Cl.
CPC ..... *A41D 13/065* (2013.01); *A41D 31/02* (2013.01); *A41D 2300/22* (2013.01); *A41D 2300/322* (2013.01); *A41D 2600/20* (2013.01)

(58) Field of Classification Search
CPC ..... A63B 71/1225; A63B 2071/1258; A63B 2209/00
USPC ..... 2/22
See application file for complete search history.

(56) References Cited

U.S. PATENT DOCUMENTS 1,782,504 A * 11/1930 Erhardt ..... A41D 17/005 36/2 R
4,484,361 A * 11/1984 Leighton ..... A41D 13/08 2/16
RE32,506 E * 9/1987 Hightower, Jr. ..... A41D 17/00 2/2.5
4,846,744 A * 7/1989 Love ..... B63B 32/45 441/75
5,010,597 A * 4/1991 Glover ..... A41D 17/02 2/22
5,435,009 A * 7/1995 Schild ..... A61F 5/0195 128/DIG. 20
5,570,470 A * 11/1996 Miller ..... A41D 13/06 2/22
5,983,391 A * 11/1999 Palmer ..... A41D 13/08 2/16
5,987,643 A * 11/1999 Beutler ..... A41D 13/0562 2/24

(Continued)

*Primary Examiner* — Anne M Kozak
(74) *Attorney, Agent, or Firm* — Craig W. Barber; Barber Legal

(57) ABSTRACT

A contractor knee pad designed for long-term comfort when working kneeling on the ground or on the floor. The kneeling work pads of the invention have a hard inner core and a comfortable outer sheath which protects the contractors knee from the inner core, a wide elastic webbing may be stretched across the back of the wearer's leg from one side of the kneeling work pads to the other. In order to provide uniform tension, a zipper is employed, the zipper of the wide elastic webbing closes downward, that is, the opposite to the most common direction. Optional strips attach to strip anchors actually on the front of the contractors kneeling word pads, which are simple studs so that the strips may be put over the stud to be held in place and no part of the attachment reaches to the back of the device.

6 Claims, 14 Drawing Sheets

(56) References Cited

U.S. PATENT DOCUMENTS 6,105,163 A * 8/2000 Edmiston ..... A41D 13/0051 2/22
6,432,513 B1 * 8/2002 Thomsen ..... A63B 71/1225 428/167
6,490,730 B1 * 12/2002 Lyden ..... A41D 13/0153 2/22
6,945,944 B2 * 9/2005 Kuiper ..... A61F 5/0104 128/882
7,069,670 B1 * 7/2006 Gerke ..... A41D 17/00 2/22
7,975,634 B1 * 7/2011 Dugan ..... A41D 13/065 112/475.06
8,745,765 B1 * 6/2014 Ahlborn ..... A41D 13/0543 2/22
9,301,553 B1 * 4/2016 Donovan ..... A41D 1/00
9,986,773 B2 * 6/2018 Kroecher ..... A41D 1/06
2001/0044946 A1 * 11/2001 Phillips ..... A41D 13/05 2/22
2003/0167548 A1 * 9/2003 LaShoto ..... A41D 13/015 2/22
2005/0071906 A1 * 4/2005 Infante ..... A63B 71/1225 2/22
2006/0107433 A1 * 5/2006 Olson ..... A61F 5/0104 2/22
2006/0156455 A1 * 7/2006 Teixeira ..... A41B 11/006 2/239
2008/0155863 A1 * 7/2008 Shor ..... A41D 17/00 36/2 R
2009/0113593 A1 * 5/2009 Mastronardi ..... A41D 13/0543 2/22
2009/0235421 A1 * 9/2009 Sash ..... A63B 71/081 2/16
2011/0185467 A1 * 8/2011 Suarez ..... A41D 13/05 2/22
2011/0277204 A1 * 11/2011 Chan ..... A41D 13/01 2/16
2011/0289656 A1 * 12/2011 Witte ..... A41B 11/006 2/239
2012/0192332 A1 * 8/2012 Mann ..... A41D 13/0543 2/22
2014/0276258 A1 * 9/2014 Hall ..... A61F 7/10 601/18
2015/0250236 A1 * 9/2015 Garcia ..... A41D 13/0543 2/22
2016/0008178 A1 * 1/2016 Babic ..... A61F 13/085 602/62
2016/0095362 A1 * 4/2016 Alomar, Jr. ..... A41D 13/065 2/22
2016/0206020 A1 * 7/2016 Knapp ..... A41D 13/0543
2018/0092791 A1 * 4/2018 Alper ..... A61H 1/008
2019/0208842 A1 * 7/2019 Gentry ..... A41D 13/0012
2019/0269558 A1 * 9/2019 Sheehan ..... A61F 5/0118

* cited by examiner

Fig. 11
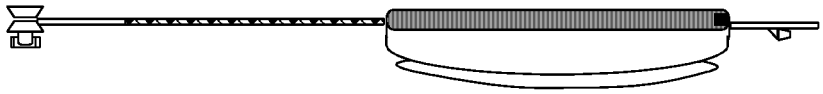
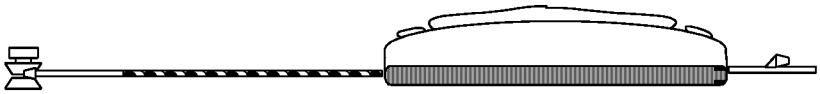
Fig. 12

ONE SIZE FITS ALL ADJUSTABLE ZIP WRAP / KNEE BRACE CONTRACTOR KNEE PADS

CROSS-REFERENCE TO RELATED APPLICATIONS

The application claims the priority and benefit of previously filed U.S. patent application Ser. No. 15/915,006 filed Mar. 7, 2018 in the name of the same inventor, Frank Quantz, the entire disclosure of which is incorporated herein by this reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but reserves all copyright rights whatsoever. 37 CFR 1.71(d).

FIELD OF THE INVENTION

This invention relates generally to work clothing and specifically to knee pads for contractors who have to kneel for long periods of time.

STATEMENT REGARDING FEDERALLY FUNDED RESEARCH

This invention was not made under contract with an agency of the US Government, nor by any agency of the US Government.

BACKGROUND OF THE INVENTION

Contractors such as landscapers and tile-layers have a difficult time working at ground level, since such work often involves kneeling for extended periods of time, even for hours.

One solution is knee pads, but most knee pads have substantial issues. Sports knee pads are not relevant or helpful for working: most are designed to protect athletes from severe injuries caused by high speed impacts from other players, hockey pucks, cleats, soccer balls and the like. In effect, sports knee pads amount to impact resistant armor. Wide webbing on a sporting knee pad makes it difficult to slide a foot through the knee pad, and it would be impossible if an athlete were for some reason wearing work boots or the like. Then work trousers such as blue jeans would get tangled when such a pad is slid up the leg all the way to the patella. Obviously this sliding would be sufficient for sporting equipment, in which a player (such as a hockey player) will be wearing tight clothing and will not yet have donned their skates, so the slide would be acceptable. In addition, a hockey or soccer player or the like can reasonably expect to don their pads once per game, and since such pads are in fact armor for impact protection, a great deal of tightness is desirable, despite the discomfort.

Gardening knee pads on the other hand are at least designed for kneeling, but they are usually constructed in ways that limits their usefulness. Most gardening knee pads have narrow straps holding them on, which cut across the back of the knee, are of light weight construction, and so on.

In general, since only straps are used to hold such pads on, there are points at which a great deal of tension is concentrated in the straps, which causes pressure points to occur against the wearer's body, specifically the back of the knee. Buckles commonly used on such straps increase the pressure points.

It would be preferable to provide a contractor's knee pad designed for hour after hour of work while kneeling, not for momentary or short-term usage and not for impact protection.

It would be preferable to provide a contractor's knee pad with an alternative to straps for holding the knee pad on, so that straps could be merely optional.

It would be preferable to provide a contractors knee pad held on with a more comfortable alternative to buckles on straps, and with a smooth flat retainer for comfort to the back of the knee.

It would further be preferable top provide a contractors knee pad with a trapezoidal planform, wider at the top than the bottom, to account for the fact that a human leg is wider above the knee (the lower thigh) compared to below the knee (the upper calf).

It would yet further be preferable to provide a contractors knee pad with a second zipper used to expand the size of the mesh so that a single device may fit most sizes of legs.

SUMMARY OF THE INVENTION

General Summary

The present invention teaches a contractor knee pad designed not for impact resistance but for long-term comfort when working kneeling on the ground or on the floor. The kneeling work pads of the invention have a hard inner core and a comfortable outer sheath which protects the contractors knee from the inner core.

Unlike most work pads for the knees, which use straps to hold the pads to the knee, the present invention teaches that a wide elastic webbing may be stretched across the back of the wearer's legf from one side of the kneeling work pads to the other. The wide webbing provides an immediate reduction in the level of concentrated pressure.

The elimination of buckles further reduces any concentration of pressure.

However, using elastic webbing with knee pads (which usually have a somewhat circular or elliptical shape) would not in itself allow the webbing to remain under uniform pressure. If the edges of the knee pads are not straight, the webbing immediately develops transverse "waves", long bumps from side to side, which then act in a manner similar to straps anyway. Thus it is necessary to provide a knee pad having straight edges to which the elastic webbing may be secured by means of a support strip running vertically up the edge of the webbing.

However as noted previously, it would be impossible to slide wide webbing over work boots, and a contractor cannot be removing their heavy footwear at the start of the day or every time they have to stand up for a period of time. In order to provide wide webbing for contractors, it is necessary to provide a means of opening and closing the webbing. The closing device cannot be something like a series of buttons which would once again create "waves" across the elastic and have the same effect as straps. In order to provide wide but also smooth elastic with complete and totally uniform tension, a zipper is employed.

Most zippers zip upward to zip a garment closed. This is acceptable for most uses, but testing has shown that for working on the ground, the zipper of the wide elastic webbing should in fact zip closed downward, that is, the opposite to the most common direction.

In addition, the device may have a second zipper which when unzipped allows extra webbing material free, thereby increasing the size of leg which the device may encompass. When zipped, the second zipper thus decreases the size of leg which the device may encompass.

In addition, it would be preferable to provide a device having a shape which is wider at the top than at the bottom (with straight sides, it becomes a trapezoidal shape) so that it may better fit the human leg, which tends to be slightly wider above the knee than below the knee.

In addition, it would be preferable to provide a device in which the webbing may have reinforcement strips or to ease manufacturing, may not have reinforcement strips down the sides.

Finally, it would be preferable to allow optional straps, but to have the straps not use buckles or the like: the straps should simply be easy to put on and take off, and smooth from one side to the other across the back of the knee. The present invention teaches strap anchors actually on the front of the contractors kneeling word pads, which are simple studs so that the straps may be put over the stud to be held in place and no part of the attachment reaches to the back of the device. For many years, straps by themselves as used for many decades, create strap burns, rip out leg hairs, and rub the user's legs raw under the wrong circumstances, as well as tending to bunch up work pants and thus make all these problems worse and reduce blood circulation. The present invention on the other hand, gets away from these problems. In the presently preferred embodiments, the optional straps are not necessary at all under normal circumstances: the comfort webbing secures the new design and makes the straps obsolete.

SUMMARY IN REFERENCE TO CLAIMS

It is therefore another aspect, advantage, objective and embodiment of the invention, in addition to those discussed previously, to provide a set of contractor knee pads for wearing on the knees of a contractor for comfort while working kneeling with the knee joint's front side on the ground or floor supporting the contractor and the knee joint's rear side free, the contractor knee pads each comprising:

front and back sides;

a hard inner protective body dimensioned and configured to conform to the shape of such kneeling human knee joint's front side;

an outer sheath of comfort padding enclosing a back side of the inner protective body; the work pads each having left and right straight edges;

left and right support strips of resilient material stitched to the respective left and right straight edges;

one support strip having a front face having one half of a zipper stitched thereto, the other support strip having an elastic webbing stitched thereto;

the elastic webbing dimensioned and configured to conform to the shape of such kneeling human knee joint's rear side;

the elastic webbing having a third support strip stitched thereto, the third support strip having a second half of the zipper stitched thereto;

whereby, when the contractor knee pad is placed on such front side of such knee joint, the elastic webbing may be stretched across such rear side of such knee joint, and the two halves of the zipper may be zipped together, comfortably securing the kneeling work pads in place.

It is therefore another aspect, advantage, objective and embodiment of the invention, in addition to those discussed previously, to provide a set of contractor knee pads, the zipper further comprising:

a slider oriented facing in an upward direction, but which slider separates the two halves of the zipper when the slider is moved upward and zips together the two halves of the zipper when the slider is moved downward, whereby:

when the zipper is zipped together, the slider rests at a bottom end of the zipper.

It is therefore another aspect, advantage, objective and embodiment of the invention, in addition to those discussed previously, to provide a set of contractor knee pads, further comprising:

a plurality of anchors projecting from a front side of the contractor knee pad, each anchor having a head;

at least one strip having two ends, each end having a buckle thereon, each buckle having an aperture dimensioned and configured to pass about one of the anchor heads and secure the end of the strip to the anchor, the strip stretching from one of the anchors on the front side of the contractor's kneeling pad across the back side of the contractor knee pad to a different one of the anchors on the front side of the contractor knee pad.

It is therefore another aspect, advantage, objective and embodiment of the invention, in addition to those discussed previously, to provide a set of contractor knee pads, further comprising:

plastic rubber gel used to create a logo visible on the front of the contractor knee pads.

It is therefore another aspect, advantage, objective and embodiment of the invention, in addition to those discussed previously, to provide a set of contractor knee pads, the outer sheath of comfort padding comprising: plastic rubber gel material.

It is therefore another aspect, advantage, objective and embodiment of the invention, in addition to those discussed previously, to provide a set of contractor knee pads, the outer sheath of comfort padding comprising: padded fabric.

It is therefore another aspect, advantage, objective and embodiment of the invention, in addition to those discussed previously, to provide a set of contractor knee pads, the hard inner protective body comprising: plastic rubber gel material.

It is therefore another aspect, advantage, objective and embodiment of the invention, in addition to those discussed previously, to provide contractor knee pads for wearing on the knees of a contractor for comfort while working kneeling with the knee joint's front side on the ground or floor supporting the contractor and the knee joint's rear side free, the contractor knee pads each comprising:

front and back sides;

a hard inner protective body dimensioned and configured to conform to the shape of such kneeling human knee joint's front side;

an outer sheath of comfort padding enclosing a back side of the inner protective body;

the work pads each having left and right edges;

one edge having one half of a first zipper attached thereto, the other edge having an elastic webbing attached thereto;

the elastic webbing dimensioned and configured to conform to the shape of such kneeling human knee joint's rear side, the elastic webbing having a width;

the elastic webbing having a distal edge having a second half of the first zipper attached thereto;

the elastic webbing having a first location intermediate to the distal edge and the work pad, the first location having one half of a second zipper attached thereto, the elastic webbing having a second location also intermediate to the distal edge and the work pad, the second location a first distance from the first location, the second location having a second half of the second zipper attached thereto, whereby, when the contractor knee pad is placed on such front side of such knee joint, the elastic webbing may be stretched across such rear side of such knee joint, and the two halves of the first zipper may be zipped together, comfortably securing the kneeling work pads in place;

and further whereby, when the second zipper is zipped closed, the width of the elastic webbing is reduced by the first distance.

It is therefore another aspect, advantage, objective and embodiment of the invention, in addition to those discussed previously, to provide contractor knee pads, the first and second zippers further comprising:

respective first and second sliders oriented facing in an upward direction, but which sliders separate the two halves of the respective first and second zippers when the respective slider is moved upward and zips together the two halves of the respective first and second zippers when the slider is moved downward, whereby:

when the zippers are zipped together, the sliders rest at a bottom end of the zipper.

It is therefore another aspect, advantage, objective and embodiment of the invention, in addition to those discussed previously, to provide contractor knee pads, further comprising:

plastic rubber gel used to create a logo visible on the front of the contractor knee pads.

It is therefore another aspect, advantage, objective and embodiment of the invention, in addition to those discussed previously, to provide contractor knee pads, the outer sheath of comfort padding comprising: plastic rubber gel material.

It is therefore another aspect, advantage, objective and embodiment of the invention, in addition to those discussed previously, to provide contractor knee pads, the outer sheath of comfort padding comprising: padded fabric.

It is therefore another aspect, advantage, objective and embodiment of the invention, in addition to those discussed previously, to provide contractor knee pads, the hard inner protective body comprising: plastic rubber gel material.

BRIEF DESCRIPTION OF THE DRAWINGS

FIG. 11 is a top view of the invention.

FIG. 12 is a bottom view of the invention.

INDEX TO REFERENCE NUMERALS

Figure 1:
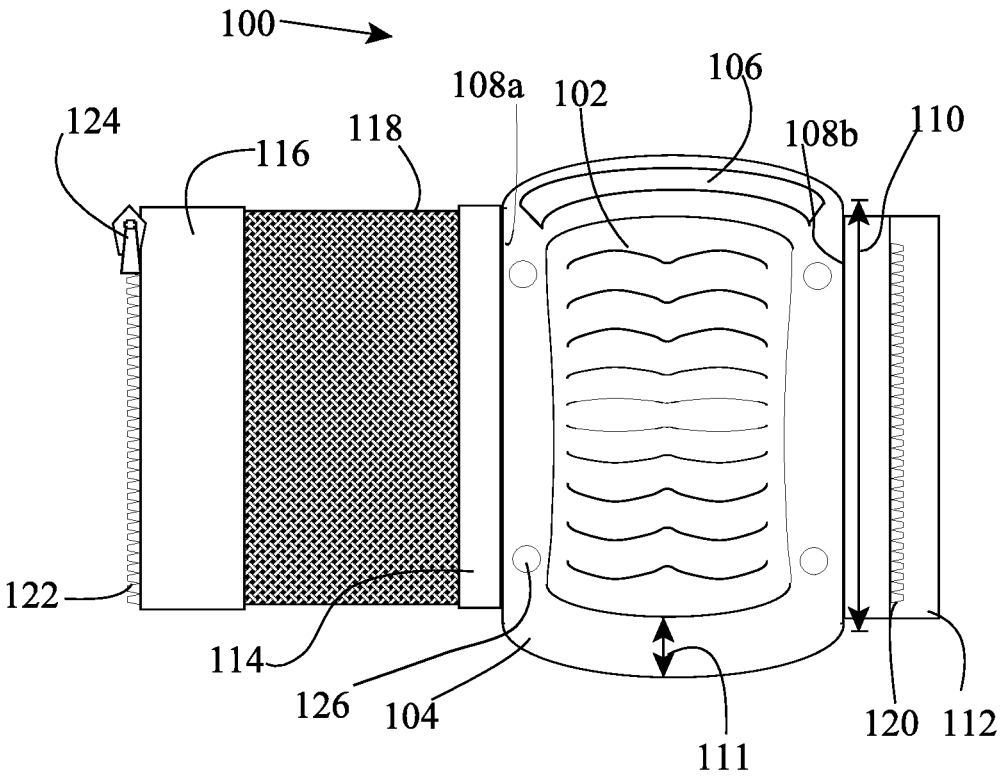
FIG. 1 is a front view diagram of a first embodiment of the invention showing the invention unzipped with the side support strips and elastic webbing both spread out sideways from the contractor knee pad.

Contractor knee pad 100
Inner knee protector 102
Outer padding 104
Logo 106
Straight edges 108*a*, 108*b*
Edge length 110
Outer padding width 111
Leg protection flange 112
Second support strip 114
Third support strip 116
Elastic webbing 118
First zipper half 120
Second zipper half 122
Slider 124
Stud 126
Stud 127
Sheath 128
Strap 130
Strap 132
Buckle 134
Buckle 136
Hole 138
Rear/side of knee 200
Elastic webbing, wider at top 318
First zipper half 320
Second zipper half 322

Slider 324
Secondary zipper for size adjustment, first half 340
Secondary zipper for size adjustment, second half 342
Secondary zipper for size adjustment, slider 344
Curved edges 408
Leg protection flange 412
Elastic webbing, wider at top 418
First zipper half 420
Second zipper half 422
Slider 424
Secondary zipper for size adjustment, first half 440
Secondary zipper for size adjustment, second half 442
Secondary zipper for size adjustment, slider 444

DETAILED DESCRIPTION

Glossary

A kneeling human knee having a front side on the ground or floor and a rear side elevated free has a common shape: the terms used in the claims are not intended to define anything other than the normal shape of a knee during kneeling. No claim is made to the parts of the human knee, only to devices shaped for the comfort of the kneeling knee shape. The claims herein use the term "such" to avoid laying any legal claim to the knee itself.

Elastic, as used in the attached claims, means that the webbing has the ability to stretch considerably from its resting shape.

Zipper as used herein means two rows of rounded teeth with a slider thereon which attaches the two halves of the zipper together when moved one direction and separates them when moved the other direction. The zipper may or may not have the "tape" part of the zipper, which function may instead be taken over by the support strips of the present invention.

End Glossary

FIG. 1 is a front view diagram of a first embodiment of the invention showing the invention unzipped with the side support strips and elastic webbing both spread out sideways from the contractor knee pad.

Contractor knee pad 100 has a body with curved top and bottom edges. The hard inner knee protector 102 may be a hard polymer material, or it may be a more comfortable material such as a polymer gel type of material. Outer padding/sheath 104 may be a more resilient material such as tough fabric, padding, polymer gel, leather, and so on. The outer padding 104 may extend around the edges of the hard inner knee protector 102 to become the sheath 128 on the back side of the kneeling work pad 100.

Logo 106 (left blank in the diagram) may be screen printed onto the outer padding 104, or may be polymer gel, plastic or the like. The logo 106 may be the maker, or a licensee, a paid advertiser, the identity of a different product promoter and so on.

Straight edges 108*a*, 108*b* are important to the elastic webbing 118 of the invention. As noted previously, if the edges of the knee pads are not straight, the webbing 118 immediately develops transverse "waves", long bumps from side to side, which then act in a manner similar to straps anyway: pressing against the leg and the back of the knees of the contractor. Thus it is necessary to provide a knee pad having straight edges 108*a*, 108*b* to which the elastic webbing may be secured by means of a support strip running vertically up the edge of the webbing.

Edge length 110 may advantageously be approximately 7 inches, though this is not required, and the outer padding width 111 may in preferred embodiments be 1.25 inches, although again this is not required. A wider range of length from 6 to 10 inches and width from ½ to 2 inches may also suffice.

Leg protection flange 112 and second support strip 114 do not extend across the back of the knee of the wearer, instead they run vertically up the length of the side edges 108*a* and 108*b*. (The leg protection flange 112 acts much like a first support strip, though in fact it is for protecting a contractor's leg from the chafing of the zipper and zipper pull.) The third support strip 116 extends along the distal edge of the elastic webbing 118. These support strips are made of a strong fabric which may itself be somewhat elastic.

Second support strip 114 is stitched to the edge 108*a* on a first edge, and is attached to the elastic webbing 118 on a second edge.

Leg protection flange 112 however is stitched to the edge 108*b* on a first edge. First zipper half 120 is attached to the leg protection flange 112, for example by stitching or bonding. It is important for the comfort of the contractor that the first zipper half 120 is not actually attached at a second edge of the leg protection flange 112, but is in a median part, set back from the edges. It is also important that it is attached to the front side of the leg protection flange 112 (as shown in FIG. 1), not to the back side. By this means the zipper is kept away from the trousers or skin of the contractor, preventing it from catching skin or hair, and preventing it from chafing the skin during long work sessions.

Second zipper half 122 however is attached to the edge of the third support strip 116, so that when the long elastic webbing is wrapped about the rear of the knee and pulling on slider 124 allows it to be zipped down (attached to) first zipper half 120, the two zipper halves are then both kept away from the skin and trousers of the contractor. In this manner the zipper also remains exposed and accessible from the outside so that slider 124 can be easily grasped and zipped upward to detach the two zipper halves.

As noted previously the most common arrangement (coats, dresses, vests, athletic clothing, etc) is to have zippers which open by being pulled down, while the invention's zipper opens when pulled upward. This has various benefits, for example, the zipper is more easily found by feel if it is further down the leg, and gravity helps hold the zipper closed.

The preferred zipper of the invention is fairly coarse, with large teeth rather than small ones, to help resist the jamming effect of dirt, grout, dust, mud and so on.

Figure 4:
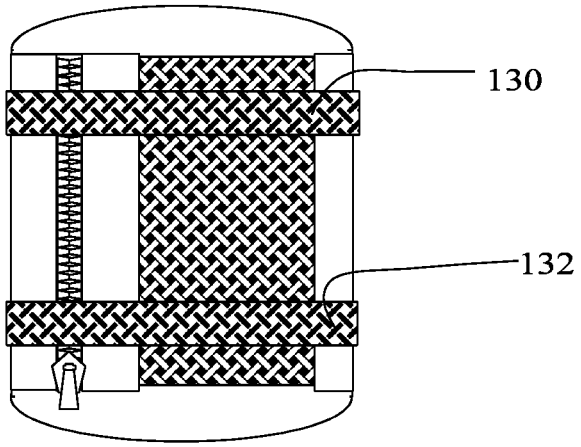
FIG. 4 is a rear view diagram of a second embodiment of the invention showing the invention zipped down with the elastic webbing, and with optional straps as well in use, stretched across the rear, as it would be in the position of being worn, but with no contractor leg depicted.
Figure 5:
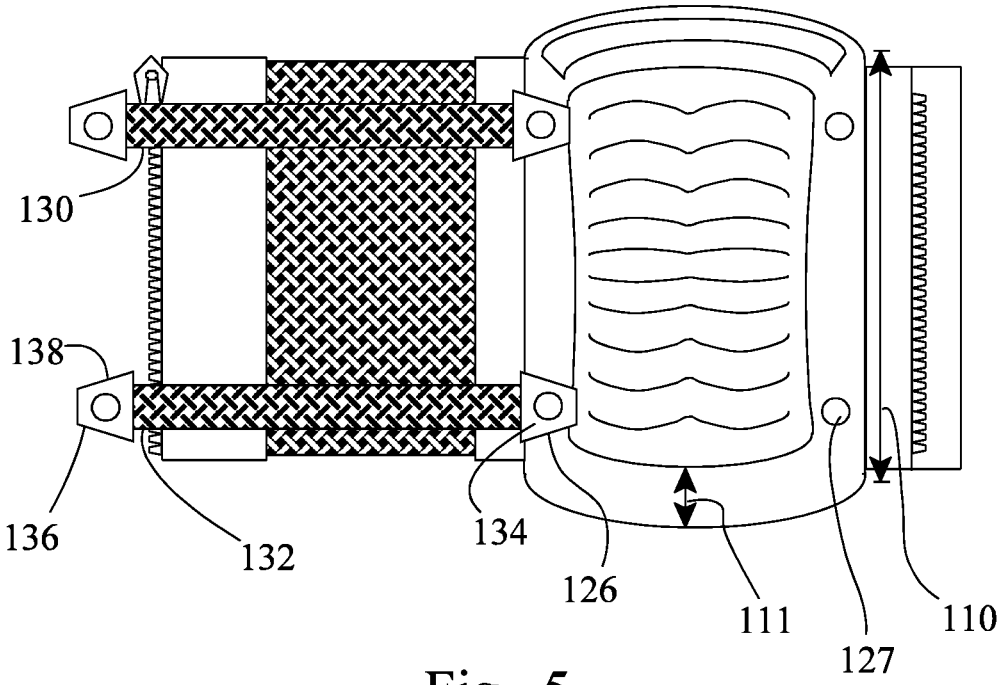
FIG. 5 is a front view diagram of the second embodiment of the invention showing the invention unzipped with the side support straps and elastic webbing both spread out sideways from the contractor knee pad, and with the optional straps attached to the anchor studs on the front of the kneeling work pad and also spread out to the sides.

Stud 126 and stud 127 are the anchors for the entirely optional straps, as discussed further in reference to FIGS. 4 and 5.

Figure 2:
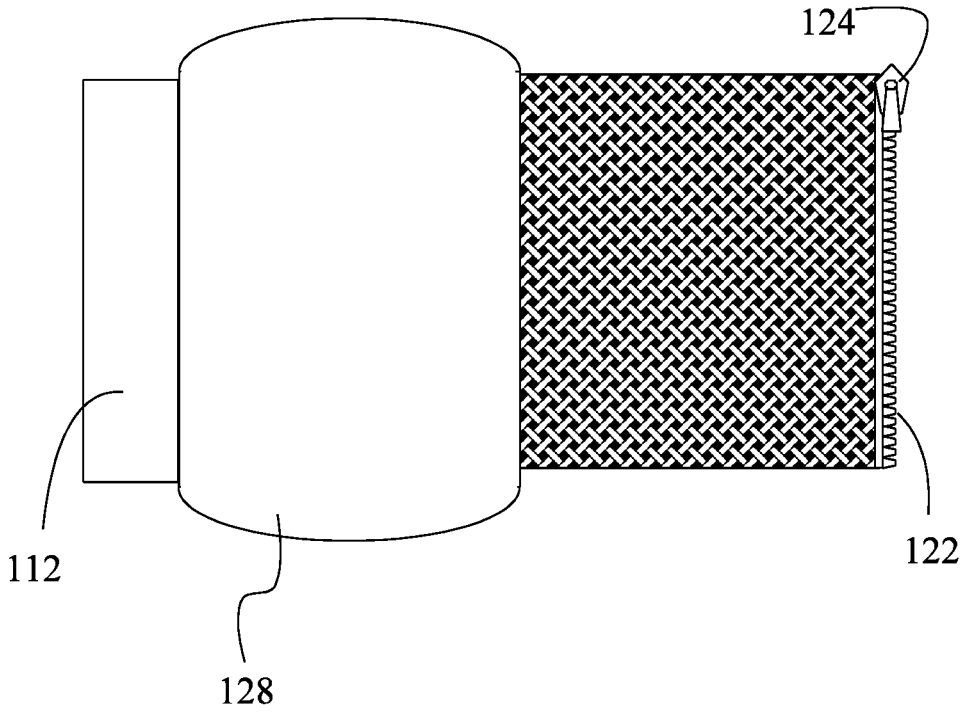
FIG. 2 is a rear view diagram of the first embodiment of the invention showing the invention unzipped with the support strips and elastic webbing spread out to the sides away from the main body.

FIG. 2 is a rear view diagram of the first embodiment of the invention showing the invention unzipped with the support strips and elastic webbing spread out to the sides away from the main body. Leg protection flange 112 has the plain back side: the zipper half on the front side is held away from the user's skin or pants. Second support strip 114 is much as previously shown.

Third support strip 116 however, may have a second pull on the slider 124 on the reverse side of the second zipper half 122, or slider 124 may have no pull on this side. If the slider 124 has no pull on this side, it is smoother against the contractor and thus more comfortable, the zipper may be less expensive to manufacture as well. Note that the pull shown on the inside is less preferred because it is less likely to be usefully accessible when the zipper halves are connected: it may be harder to reach.

Sheath 128 may be seen. It may be a continuation of the outer padding 104 or it may be separate. It should be a comfortable and firm cushion, since it is the part which will hold the contractor's patella (knee bone) away from the hard inner core 102. Thus it may be a polymer gel pad, a foam material (firmer closed cell foam or softer open cell foam), a thick fabric, and so on.

Figure 3:
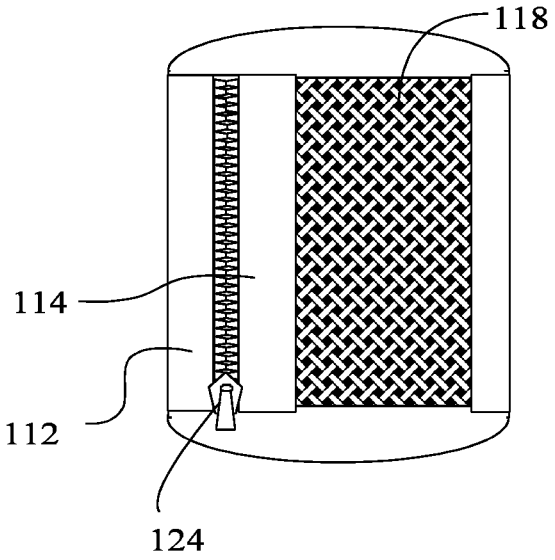
FIG. 3 is a rear view diagram of the first embodiment of the invention showing the invention zipped down with the elastic webbing stretched across the rear, as it would be in the position of being worn, but with no contractor leg depicted.

FIG. 3 is a rear view diagram of the first embodiment of the invention showing the invention zipped down with the elastic webbing stretched across the rear, as it would be in the position of being worn, but with no contractor leg depicted. Leg protection flange 112 is zipped to second support strip 114, with elastic webbing 118 stretching across the broad back of the invention.

Slider 124 is at the bottom, since it is closed.

FIG. 4 is a rear view diagram of a second embodiment of the invention showing the invention zipped down with the elastic webbing, and with optional straps as well in use, stretched across the rear, as it would be in the position of being worn, but with no contractor leg depicted. Strap 130 and strap 132 may provide a more traditional feel for the contractor, and may provide more firmness: note that in this configuration/embodiment, the device has the elastic webbing AND the straps to hold it onto the back of the knee.

FIG. 5 is a front view diagram of the second embodiment of the invention showing the invention unzipped with the optional side support straps and elastic webbing both spread out sideways from the contractor knee pad, and with the optional straps attached to the anchor studs on the front of the kneeling work pad and also spread out to the sides. Stud 126 carries and anchors one end of strap 132, while stud 127 will carry the other end. Strap 130 will be held in a similar manner by the two upper studs.

Strap 132 has two "buckles" 134 and 136 which may simply be flat plates with apertures (like hole 138) passing through. Obviously the hole need not be a simple circle but may be a keyhole shape. Buckle 134 is securely anchored to the stud 126 by having the hole passed over the stud, and then allowing the tension of the strap 132 to pull the buckle onto the narrower part of the stud (which is not visible, being underneath the stud head).

Figure 6:
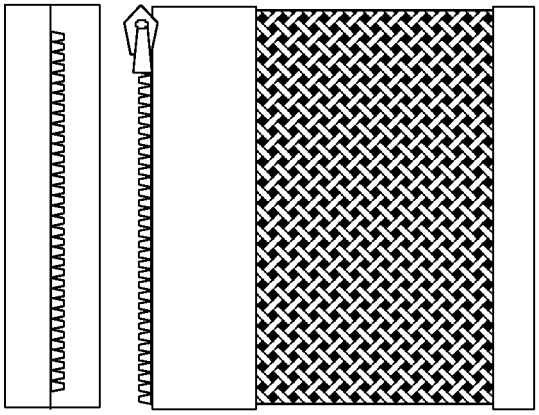
FIG. 6 is a front view diagram of a third embodiment of the invention, a retrofit kit with the elastic webbing for attachment to a kneeling work pad.
Figure 7:
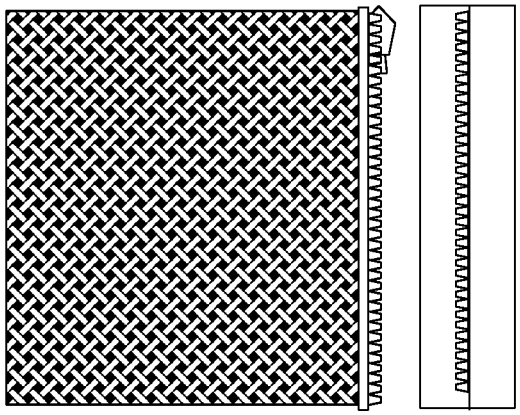
FIG. 7 is a rear view diagram of a third embodiment of the invention, a retrofit kit with the elastic webbing for attachment to a kneeling work pad.

FIG. 6 is a front view diagram of a third embodiment of the invention, a retrofit kit with the elastic webbing for attachment to kneeling work pad. Note that in this embodiment one support strip is omitted on one side of the elastic: the elastic webbing may be attached (perhaps by sonic bonding, adhesives, stitching, etc) directly to the edge material of the kneeling work pad. FIG. 7 is a rear view diagram of the same third embodiment of the invention, the retrofit kit with the elastic webbing for attachment to kneeling work pad. This embodiment shows the preferred slide, which has not pull on the inside.

Figure 8:
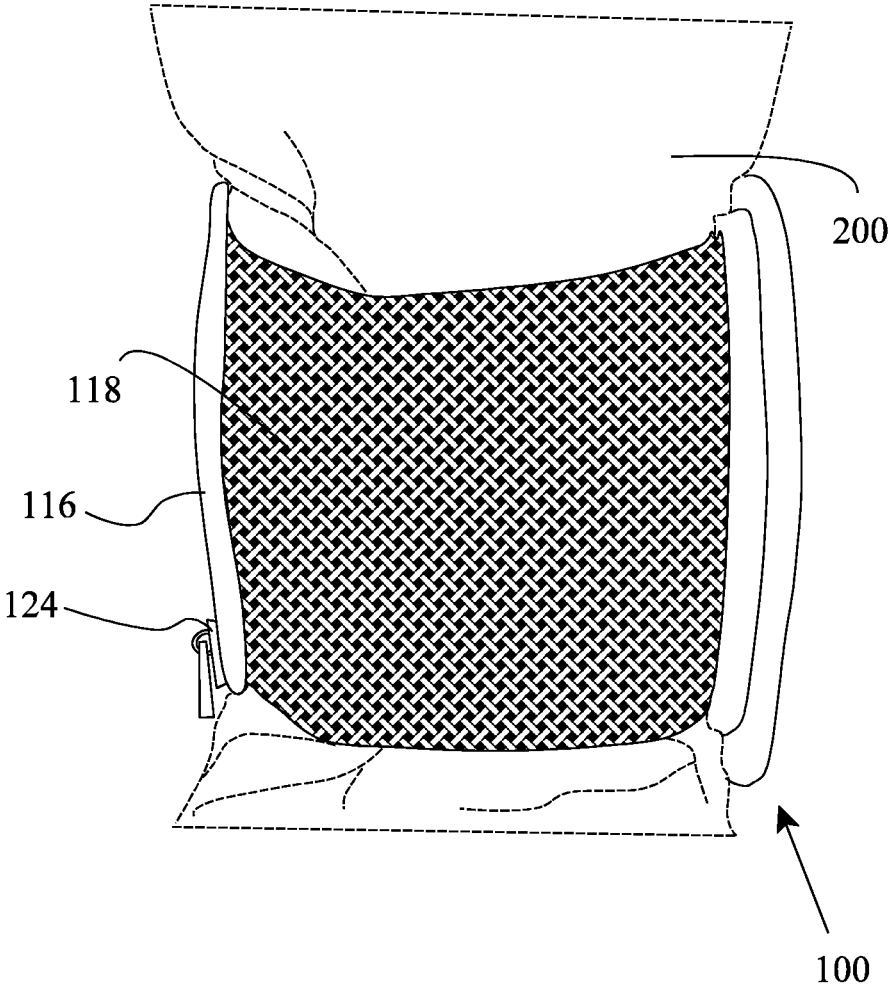
FIG. 8 is an oblique rear and side view diagram (a diagonal angle) of the invention worn on a contractor's knee in the position of use: the knee is bent for kneeling on the ground (though this is not easily seen except from a straight side view).

FIG. 8 is an oblique rear and side view diagram (a diagonal angle) of the invention worn on a contractor's knee in the position of use: the knee is bent for kneeling on the ground (though this is not easily seen except from a straight side view). Third support strip 116 is visible edge on, with slider 124 at the very bottom: the zipper is concealed at this angle, which is half way between a side view and a rear view. The elastic webbing 118 is attached to a support strip which is itself attached to the edge of the kneeling work pad.

Rear/side of knee 200 (as noted previously, no claim is made to human body parts), may be seen in broken/dashed lines, with the clothing of the contractor relatively smooth and un-rumpled by the addition of the zipped-on working knee pad.

Figure 9:
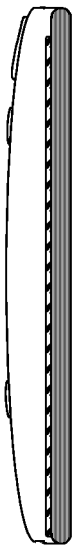
FIG. 9 is a left side view of the invention with the single visible support elastic stretched out to the side.
Figure 10:
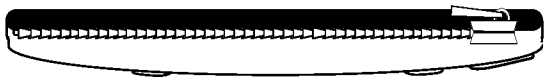
FIG. 10 is a right side view of the invention with the single visible support webbing stretched out to the side.

FIG. 9 is a left side view of the invention with the single visible support strip stretched out to the side. FIG. 10 is a right side view of the invention with the single visible support strip stretched out to the side, showing the same features. The slider may be seen at the top of the zipper in FIG. 10. The stud heads (the wider top part of the studs) are also visible edge on, as is the slightly raised logo above them.

FIG. 11 is a top view of the invention, with the elastic webbing seen extending out one side, and the logo protruding slightly, while FIG. 12 is a bottom view of the invention with the inner cap/core protruding slightly, and the heads of the studs slightly visible.

Figure 13:
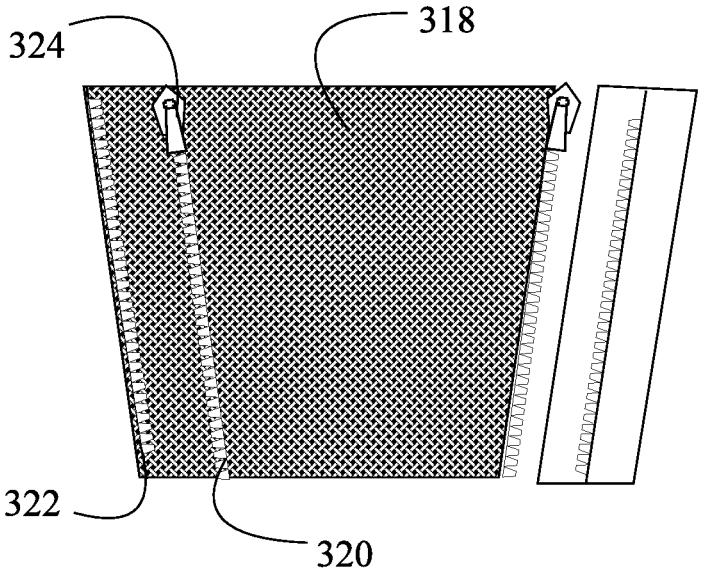
FIG. 13 is a rear view diagram of a fourth embodiment of the invention, a retrofit kit with the elastic webbing for attachment to a kneeling work pad but with a trapezoidal shape which is wider at the top than the bottom.

FIG. 13 is a rear view diagram of a fourth embodiment of the invention, a retrofit kit with the elastic webbing for attachment to a kneeling work pad but with a trapezoidal shape which is wider at the top than the bottom.

Elastic webbing 318 is wider at the top than at the bottom, thus allowing more space for the user's leg at the top. This matches the configuration of most legs, which are wider at the bottom of the thigh than at the top of the calf.

In practice, it has been found that a useful size for contractors is webbing which is 11 inches wide at the top, in total, and 9 inches wide at the bottom.

However, in this embodiment there are now two zippers rather than one. The first zipper is still present and is still used to put the contractors kneeling work pads on: first zipper half 320, second zipper half 322 and slider 324 are as previously described, but angled due to the different shape of webbing. The new feature is the second zipper, which is used for size adjustments.

Because human being's legs vary widely in size, the secondary zipper for size adjustment is provided to allow the device to be made wider or narrower. Second zipper first half 340 and second zipper second half 342 are shown separated. Note that in this embodiment they are perfectly parallel. The second slider 344 may be seen in the up or UNZIPPED configuration.

It has been found in testing that second zipper halves two inches apart provide sufficient "take up" or pleating to make the device suitable for a very wide range of legs, i.e. "One Size Fits All". When the second zipper is zipped DOWN, that is, together, the device becomes 9 inches wide at the top and 7 inches wide at the bottom. Webbing 7½ inches deep has been tested to be comfortable in either size.

Note that the second zipper also zips closed in the downward direction. As mentioned previously, zipping up works well for winter parkas or boots or the like, but is found to be less satisfactory at remaining closed in the circumstances of constant kneeling. When kneeling, unlike when walking, bicycle riding, skating, or athletics, there is not just the constant flexure of the knee joint, there is also the aspect of constantly shifting pressure applied to the kneeling pad from the outside. This pressure, sideways friction forces with the dirt, and so on, are all absent or quite infrequent in sporting activities. For example, in sporting activities, protective gear is designed to avoid injury from occasional impact. On the other hand for a kneeling contractor, the protective gear is for comfort but also for protection from the constant imposition of sideways friction, small objects like pebbles and sticks being driven into the knee, and so on.

Figure 14:
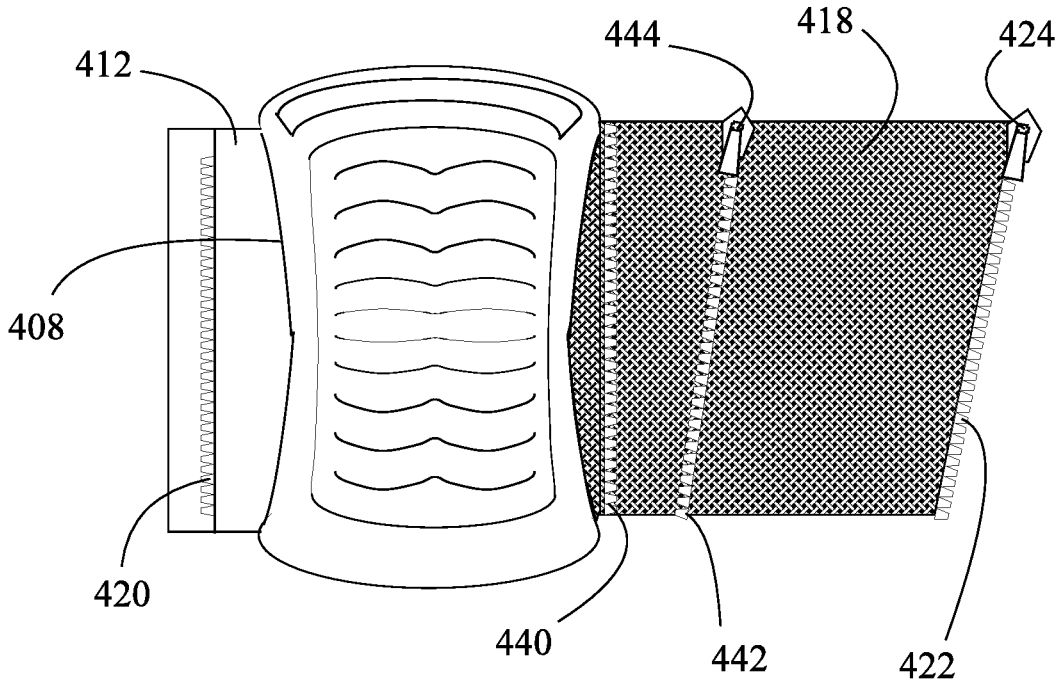
FIG. 14 is a front view diagram of the presently preferred fifth embodiment of the invention showing the invention unzipped with the elastic webbing spread out to the sides away from the main body, which is wider at the top than at the bottom. In this view the second zipper is also unzipped open to expand the leg size.

FIG. 14 is a front view diagram of the presently preferred fifth embodiment of the invention showing the invention unzipped with the elastic webbing spread out to the sides away from the main body, which is wider at the top than at the bottom. In this view the second zipper is also unzipped open to expand the leg size.

Curved edges 408 may be seen for the central protector, unlike in previous embodiments. In this embodiment, it may be desirable to have the knee pad/protector, like the webbing, be some shape other than rectangular. The figure eight shape shown is one possibility, and having the knee pad be wider at the top, just like the webbing is, is one possibility as well. Thus the edges need not be straight.

Leg protection flange 412, as previously described, protects the leg from the first zipper. Note that the second zipper will require no protection flange because it is disposed on the outside of the webbing 418, not the inside.

Elastic webbing 418 is wider at the top than the bottom, and other than the zipper halves may have no support strips. Note that the embodiment also does not need optional straps. First zipper half 420 and second zipper half 422 and slider 424 are as described in previous embodiments: they zip downward to close and upward to open, may be a heavy duty zipper with broad teeth to help withstand the constant exposure to dirt and grit being driven into them during kneeling work, and so on.

The secondary zipper for size adjustment, has first half 440, second half 442, and slider 444. These are not quite parallel in this embodiment: careful inspection of the figure will reveal that two halves of the zipper 440 and 442 diverge more at the top and the bottom. This is because the leg is wider at the top than the bottom and the difference is based on the size of the legs: larger legs are "more wider" at the top while smaller legs are "wider at the top but not as much wider" at the top.

Figure 15:
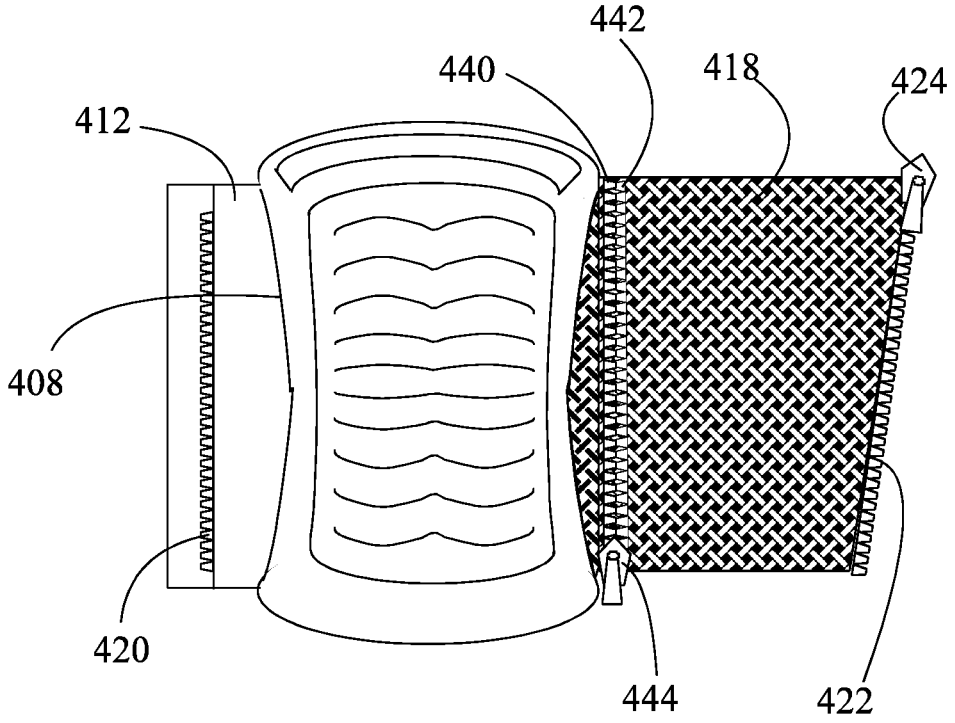
FIG. 15 is a front view diagram of the fifth embodiment of the invention showing the invention unzipped with the elastic webbing spread out to the sides away from the main body, which is wider at the top than at the bottom, but with the second zipper closed to decrease the leg size.

FIG. 15 is a front view diagram of the fifth embodiment of the invention showing the invention with the FIRST zipper (but not the second) unzipped with the elastic webbing spread out to the sides away from the main body, which is wider at the top than at the bottom, but with the second zipper closed to decrease the leg size.

Leg protection flange 412, the elastic webbing 418 and the zipper halves 420 and 422 with slider 424 are as previously described. This is the zipper which is unzipped (up) to spread the device for inspection.

In this diagram, the secondary zipper's first half 440 and the second half 442 are zipped together and the slider 444 is at the bottom of the zip. The webbing has been reduced in width and thus fits a smaller leg snugly.

Thus this configuration of the device can be considered to be size "S/M" while the configuration of the exact same device shown in FIG. 14 may be considered to be size "L/XL". And merely by zipping or unzipping the second zipper, the device can be switched from one to the other.

For many years, straps by themselves as used for many decades, create strap burns, rip out leg hairs, and rub the user's legs raw under the wrong circumstances, as well as tending to bunch up work pants and thus make all these problems worse and reduce blood circulation. The present invention on the other hand, gets away from these problems. In the presently preferred embodiments, the optional straps are not necessary at all under normal circumstances: the comfort webbing secures the new design and makes the straps obsolete.

The disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. Contractor knee pads for wearing on the knees of a contractor for comfort while working and kneeling with the knee joint's front side on the ground or floor supporting the contractor and the knee joint's rear side free, the contractor knee pads each comprising:

front and back sides;

a hard inner protective body dimensioned and configured to conform to the shape of such kneeling human knee joint's front side;

an outer sheath of comfort padding enclosing a back side of the inner protective body;

the hard inner protective body and outer sheath forming a work pad having left and right edges;

one edge of the left and right edges having a first half of a first zipper attached thereto on a leg protection flange, the first half of the first zipper being attached on a front side of the leg protection flange, the other edge of the left and right edges having an elastic webbing attached thereto;

the elastic webbing dimensioned and configured to conform to the shape of such kneeling human knee joint's rear side, the elastic webbing having a top edge and a bottom edge, the top edge having a top width and the bottom edge having a bottom width;

the top width being greater than the bottom width;

the elastic webbing having a distal edge having a second half of the first zipper attached thereto;

the elastic webbing having a first location intermediate to the distal edge and the work pad, the first location having a first half of a second zipper attached thereto, the elastic webbing having a second location also intermediate to the distal edge and the work pad, the second location spaced apart from the first location, the second location having a second half of the second zipper attached thereto, the first and second halves of the second zipper non-parallel on the elastic webbing and diverging more at the top edge of the elastic webbing than at the bottom edge of the elastic webbing such that the second halves of the first zipper and the second zipper extend further distally at the top edge of the elastic webbing than at the bottom edge of the elastic webbing in an unzipped configuration and with respect to the work pad;

whereby, when each contractor knee pad is placed on such front side of such knee joint, the elastic webbing is configured to be stretched across such rear side of such knee joint, and the two halves of the first zipper is configured to be zipped together, comfortably securing the kneeling work pads in place;

and further whereby, when the second zipper is zipped closed, the width of the elastic webbing is reduced more at the top edge than at the bottom edge.

2. The contractor knee pads of claim 1, the first and second zippers further comprising:

respective first and second sliders oriented such that the first and second sliders separate the two halves of the respective first and second zippers when the respective slider is moved upward and zips together the two halves of the respective first and second zippers when the respective slider is moved downward, whereby:

when the zippers are zipped together, the sliders rest at a bottom end of the zipper.

3. The contractor knee pads of claim 2, further comprising:

a logo visible on the front of the contractor knee pads, the logo comprising one member selected from the group including plastic, rubber, gel and combinations thereof.

4. The contractor knee pads of claim 2, the outer sheath of comfort padding comprising: one member selected from the group including plastic, rubber, gel and combinations thereof.

5. The contractor knee pads of claim 2, the outer sheath of comfort padding comprising: padded fabric.

6. The contractor knee pads of claim 2, the hard inner protective body comprising: one member selected from the group including plastic, rubber, gel and combinations thereof.

* * * * *